US005557151A

United States Patent [19]

Epstein et al.

[11] Patent Number: 5,557,151

[45] Date of Patent: Sep. 17, 1996

[54] METHOD OF MAKING A GAS GENERATION COMPOSITION

[75] Inventors: Brett N. Epstein, Las Vegas, Nev.; Mark A. Griesbach, Hortonville, Wis.; Earl F. Kurtz, Las Vegas, Nev.

[73] Assignee: Legend Products Corporation, Las Vegas, Nev.

[21] Appl. No.: 187,744

[22] Filed: Jan. 26, 1994

[51] Int. Cl.[6] ..... C06B 21/00

[52] U.S. Cl. ..... 264/3.4; 264/3.1

[58] Field of Search ..... 264/3.1, 3.4

[56] References Cited

U.S. PATENT DOCUMENTS 4,497,676 2/1985 Kurtz ..... 149/2

4,728,376 3/1988 Kurtz ..... 149/21

4,964,929 10/1990 Beyeler et al. ..... 149/109.6

4,997,496 3/1991 Wehrli ..... 149/18

*Primary Examiner*—Peter A. Nelson

*Attorney, Agent, or Firm*—Donald W. Margolis

[57] ABSTRACT

A method of making gas generation compositions is provided comprising the steps of dry mixing an oxidizing agent, an organic acid, an iron compound and carbon to form a dry mixed product composition, without cooking, and then introducing a binder, such as water, to the composition, compacting the bound composition, comminuting the compacted bound composition to form granules and drying the compacted granules without cooking.

38 Claims, 1 Drawing Sheet

METHOD OF MAKING A GAS GENERATION COMPOSITION

BACKGROUND OF THE INVENTION

1. Field of the Invention

The present invention relates to methods of making gas generation compositions, and to the compositions made by those methods which are mixtures of solid particles containing organic material, and which may have utility as explosives or as gunpowder substitutes.

2. Description of the Prior Art

From the date of their earliest discovery in ancient China, compositions which generate large volumes of gas when they are subjected to combustion have been found to be suitable for use as fuels, as explosives, as propellants, including as propellants for ammunition, as a deflagrating agents, and as a pyrotechnic compounds. Such gas generation compositions have generally included a fuel component and an oxidizer component. In chemical terms, the fuel component serves as a reducing agent, and the oxidizer component serves as an oxidizing agent. By way of example, black powder has been used for centuries as a gas generation composition, and especially as gunpowder. Black powder is commonly composed of an intimate mixture of potassium nitrate, sulfur and charcoal. In black powder, potassium nitrate is the oxidizing agent, while the sulfur and charcoal comprise the fuel component. The end products resulting from the combustion of black powder are noxious smoke, hot residue, and materials which foul most weapons in which the material is discharged. Black powder also exhibits some hygroscopicity, which can limit its shelf life and which creates unpredictability as to its performance. In addition, black powder is easily ignited, and is therefore extremely dangerous to manufacture, to store and to handle. The deficiencies exhibited by black powder are a direct result of the fuel and oxidizer materials which comprise black powder.

Gas generating compositions have been formulated which exhibit improved safety or performance characteristics over black powder when used as a gunpowder. One such composition is Pyrodex®, a composition of potassium nitrate, sulfur, charcoal, potassium perchlorate, various binders and modifiers and other constituents.

Another such gunpowder substitute is described in Kurtz U.S. Pat. No. 4,497,676. This reference describes a technique for making such a composition from an aqueous slurry of an organic acid, such as ascorbic or erythorbic acid, and an inorganic nitrate, such as potassium nitrate, which, when heated to drive off the water, produces a composite material which is useful as an explosive and propellent. The material is ballistically comparable in performance to black powder.

Kurtz U.S. Pat. No. 4,728,376 describes an improvement in the composition of the Kurtz '676 patent, wherein the mixture is heated at elevated temperatures during processing. The heating produces a clearly identifiable reaction which results in a chemical and/or physical change in the organic acid portion.

The requirement in the above-referenced patents to utilize a cooking process degrades the organic acid, and causes limited performance capabilities and excessive hygroscopicity, which, in turn, leads to product storage, handling and performance problems. Also, during the cooking process, the ignition and explosion danger increases dramatically, especially when the composition is produced in bulk.

An effort to overcome the above-identified disadvantages is taught in Wehrli U.S. Pat. No. 4,997,496. Wehrli describes an explosive and propellent composition comprising an admixture of ascorbic acid and a nitrate-containing oxidation agent which does not require the same cooking processes as the above-identified Kurtz patents. However, in order to achieve a useful level of ballistic performance of the type required, for example, in a variety of explosive and propellent applications, the Wehrli composition requires initial grinding and milling of both the ascorbic acid and the oxidation agent for from 25 to 30 hours in order to obtain a particle size of about 10 microns or less. The achievement of such small particle sizes requires such long grinding and milling times that the handling time and expense in producing the composition is dramatically increased, and the long handling time also increases the danger potential during the production of the composition.

SUMMARY OF THE INVENTION

U.S. patent application Ser. No. 07/851,753, filed Mar. 16, 1992, and assigned to the same assignee as the present application describes a fuel and explosive composition and its teachings are incorporated herein by reference.

The present invention provides a method of making a substitute for black powder gas generation compositions, and to the compositions produced by the process. The method includes the steps of dry mixing an oxidizing agent, and an organic acid, and in preferred embodiments, iron or an iron compound, and carbon, to form a mixture. While milling is not required, where the ingredients are dry mixed, this may be carried out, for example in a ball mill. When the dry ingredients are ball milled, they are mixed and reduced in size for a time period of from only about 30 minutes, or less, to no more than about 180 minutes, with about 90 minutes being a good average milling time when starting with commercial grade materials. During this relatively short mixing and milling time, as compared to Wehrli U.S. Pat. No. 4,997,496, a majority of the ingredients are reduced in size to a range of between about 100 microns to about 150 microns, with some particles as small as 30 microns and some particles as large as 500 microns. The fact that some particles are smaller than 100 microns is primarily a function of the size of the starting ingredients, rather than a function of the mixing or milling time, and there is no requirement to have particles smaller than about 100 microns in the practice of the present invention.

A minor amount of water or other binder material, such as vegetable starch, may be added to the dry mixed composition. In addition to acting as a binder, these materials also serve to reduce the dust in the composition. While not required, in preferred embodiments, this is then followed by compacting of the compositions, for example into thin sheets between rollers, such as a roll mill press apparatus, with the press apparatus exerting, pressure on the mixture and forming it into thin sheets. The pressure applied by the roll mill may be up to about 40,000 pounds per square inch (psi), or more. The resulting thin sheets are then allowed to desiccate under ambient or gently heated conditions until they are dry and brittle, as detailed below. After drying, the thin sheets are comminuted, for example in a granulator or punch press, and may then be screened to obtained selected sizes of granules for selected uses. The resulting composition has good to excellent utility as a gas generation composition, and may be substituted for substantially all uses for which gas generation compositions are now used, including, but not limited to use as propellants in large and small firearms, as explosives, and in any other traditional black powder use.

In preferred embodiments the mixture may include from about 40% to about 90%, by weight, of a nitrate oxidizing agent composition; from about 10% to about 60%, by weight, of an organic acid reducing agent; from about 0% to about 15%, by weight, of carbon material; and from about 0% to about 15%, by weight, of iron or an iron compound. In more preferred embodiments the mixture may include from about 55% to about 75%, by weight, of a nitrate composition, such as potassium nitrate; from about 10% to about 40%, by weight, of an organic acid, such as ascorbic acid or erythorbic acid; from about 0% to about 7%, by weight, of carbon, such as charcoal; and from about 0% to about 7%, by weight, of iron or an iron compound, such as iron oxide. The carbon and the iron compound will normally be present in closely equivalent amounts, by weight. Once the starting materials are mixed, and before further processing, a binder, such as water or starch in an amount from about 0% to about 10%, by weight, of the weight of the dry mixture is added, with less than 5% binder, by weight, of the weight of the dry mixture being preferred.

These and other objects of the present invention will become apparent to those skilled in the art from the following detailed description, showing the contemplated novel method, composition, product and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings which are incorporated in and form a part of the specification, help to explain the use of preferred embodiment compositions of the present invention, together with descriptions according to the best modes presently devised for the practical application of the principles thereof, and in which.

DETAILED DESCRIPTION OF THE PREFERRED EMBODIMENT

Figure 1:
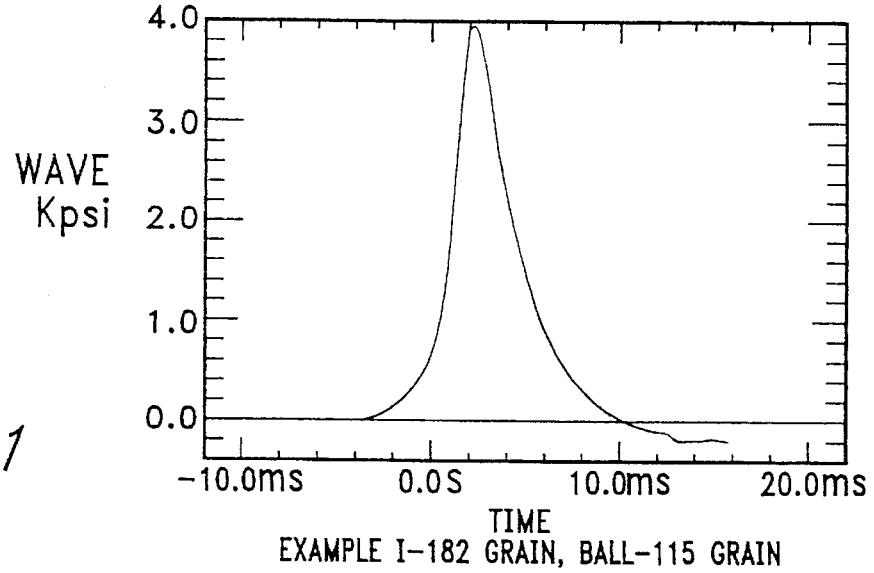
FIGS. 1–3 are representative graphs of pressure evolved versus time curves utilizing the gunpowder substitute composition produced according to the teaching of the present invention, and of commercial Pyrodex and Goex gunpowder substitute composition, respectively.

The present invention is based on the discovery that uncooked mixtures of organic acid, such as ascorbic acid or erythorbic acid, and a nitrate-containing oxidation agent, in a size range of from about 30 microns to about 500 microns, and which can be prepared either without milling, or with milling not required to exceed 90 minutes, provides a composition which, when produced in accordance with the method of the present invention, is useful, for substantially all uses for which gas generation compositions are now used. As used herein and in the claims, the term "cooking" means the addition of heat energy from an external source in an amount which will raise the temperature of the composition to about 150° F., or below the decomposition temperature of the organic acid, whichever is the lower temperature.

In the practice of the present invention, the gas generating composition is formed by mixing its ingredients in an art known, grounded container. As noted above, the ingredients include an organic acid, such as ascorbic acid or erythorbic acid, and a nitrate-containing oxidation agent, and also preferably iron or iron oxide and carbon. Commercial grade starting materials are satisfactory for the practice of the invention.

The relative proportions of the ingredients can vary widely in the composition, depending on specific applications and particular requirements for such applications. In general, however, it has been determined that the optimum weight percentages of the ingredients range from about 40% to about 90%, by weight, potassium nitrate; from about 10% to about 60%, by weight, ascorbic acid or erythorbic acid; from about 0% to about 15%, by weight, charcoal; and from about 0% to about 15%, by weight, of iron or an iron oxide compound.

In even more preferred embodiments the mixture may include from about 55% to about 75%, by weight, of a nitrate composition; from about 10% to about 40%, by weight, of ascorbic acid or erythorbic acid; from about 0% to about 7%, by weight, charcoal and from about 0% to about 7%, by weight, iron or an iron oxide compound. Once mixed, binder material, such as water or starch from about 0% to about 10%, by weight, of the weight of the dry mixture may be added in order to make the composition easier to handle, with less than 5%, by weight, of the weight of the dry mixture being preferred. Other binder ingredients may also be used, as noted below.

It is preferred to use an alkali or alkaline earth metal nitrate or ammonium nitrate as the oxidizing agent, with potassium nitrate being most preferred. Such nitrates can be employed individually or in various combinations. Potassium nitrate is the most preferred oxidizing agent.

While charcoal is not necessary for the preparation of the composition, it can be a useful ingredient, in preferred embodiments of the gas generating composition of the present invention. For example, it has been determined that the presence of charcoal appears to lower the ignition temperature of the composition. Thus, the addition of charcoal to the composition allows for easier and more consistent ignition of the composition produced by the process of the present invention, especially, for example, when used as a black powder substitute in the pan of a flintlock type of firearm.

The presence of iron or an iron compound in the composition appears to provide some benefits to the final gas generating composition when it is used as a propellent. Without fully understanding the reaction, the efficiency, reliability and speed of the reaction of the composition appears to be aided by the presence of iron or an iron compound, and it is speculated that this may be due to an increase in the conductivity of the composition or the creation of a hotter burn after ignition of the composition. Although the chemical and/or physical changes resulting from the presence of iron or an iron compound are not precisely known, the resulting composition appears to require less activation energy to initiate the oxidation-reduction process of the gas generating reaction. When added to the composition, iron or an iron compound, also appears to react with other components of the composition, such as the ascorbic acid, as denoted by a purple colored reaction product which can be seen when not masked by the color of the other ingredients, such as for example, by the blackness of iron oxide. It is postulated that when iron oxide is present the ascorbic acid and nitrate reacts with it stoichiometrically. It is possible that if sufficient iron oxide is present there will be a lack of "free" nitrate that one would expect to find in low explosive gas generating compositions which use nitrates as an oxidizer. The reaction between ascorbic acid and/or nitrate and iron oxide is believed to be self induced and relatively rapid in the presence of water. However, it is believed that the chemical reaction between ascorbic acid and/or nitrate and iron oxide will proceed over time with very little added water. Furthermore, it appears that if the ingredients are compacted the amount of included water in the iron oxide, the potassium nitrate, and the ascorbic acid in their natural state is sufficient to sustain the reaction, although the reaction is made quicker and easier with the addition of water. Also, compaction of the ingredients is believed to spread the naturally available included water between the ascorbic acid, the nitrate and the iron oxide to initiate the chemical reaction. The higher the compaction pressure, the more quickly and efficiently the water is spread throughout the composition, thereby encouraging the reaction to take place. It is believed that the chemical reaction between the ascorbic acid, the nitrate and iron oxide allows the product to be made safer, and to increase its shelf life.

In the methods described herein, the enhancing effect of iron or of an iron compound in the gas generating compositions is generally provided by the addition of ferrous oxide ($Fe_3O_4$) to the composition. Other iron oxides which can be used include ferrous oxide (FeO) and ferric oxide ($Fe_2O_3$). Such iron oxides are preferably produced by reaction of an organic acid with an iron compound. Mixtures of iron and of iron compounds may also be used in the practice of the present invention.

METHODS OF PREPARING GAS GENERATION COMPOSITIONS

Not surprisingly, the starting ingredients are placed in a suitable container and are mixed, without the addition of water or any other solvent. Mixing may be accomplished using any method, apparatus or equipment, and preferably in a manner which will not generate static or sparks which could cause the composition to ignite during mixing. If a majority of the starting ingredients used to produce the composition, namely the oxidizing agent, the organic acid, the iron compound and the charcoal, have particle sizes in excess of about 150 microns, it is preferred that the ingredients be ground or otherwise reduced in size. Such size reduction may be accomplished by the use of a ball mill, normally for from about 30 minutes to no more than about 180 minutes, with 90 minutes being a good average time for grinding commercial grade starting materials. While milling time in excess of 120 minutes may be applied, and would be within the teaching of the present invention, it is not required in order to achieve the desired particle size of the present invention. In fact, it has been found that ball milling the materials for more then about 180 minutes will cause them to agglomerate and form clumps, rather than to be further reduced in size. Such a short mixing and milling procedure typically results in a composition in which the majority of the ingredients are sized between about 100 microns and about 150 microns, although some particles may be as small as 30 microns and some particles as large as 500 microns.

The milling apparatus can be of any known type, and in practice has been a grounded ball mill using a charge of glass or ceramic marbles as the grinding medium. Typically, the milling time depends upon the original particle size of the ingredients, although, as noted above, about 90 minutes is usually sufficient when using commercial grade starting ingredients. If substantially all of the starting materials have particle sizes of less than about 150 microns, than the ingredients may be mixed together without the use of a ball mill.

When the ingredients have been thoroughly mixed, and if desired, reduced in size, the resulting composition then has the capability of being utilized as a gas generation composition, for example as a propellent, without a cooking step, but will not have as desirable properties as if the following steps are taken.

In preferred embodiments, a "binder" material, preferably water, will next be added to the composition, although the addition of water is optional. When water is added, the amount of water added need only be enough to moisten the composition. Experimentation has therefore shown that the amount of water normally ranges from between about 0% and about 5%, by weight of the dry composition, with the optimum amount of water being about 1.5% by weight of the dry composition. While not preferred, other materials may be used as a binder, for example vegetable starch, such as corn starch or ethyl cellulose. The so called "binder" materials also assist in compacting the material, as detailed below.

It should be noted that on relatively high humidity days, the amount of binder, such as water, starch or the like may actually be less than 1.5% by weight. This can be contrasted to relatively low humidity days, during which the amount of binder, such as water or starch can be as much as about 5% by weight, or more. Within the 0% to about 10% ranges taught herein, too much moisture added to the mixture will not affect the firing of the subsequently dried composition, but will cause the composition to stick to the pressing apparatus, as detailed below. When binder in the form of water is added to the composition it becomes difficult to screen, until it is dried and comminuted.

Whether the composition has a binder added to it or not, the composition is next preferably compacted. Compacting may either be accomplished by the formation of thin sheets, or by the use of a punch press or rotary press, all as detailed below.

Compaction is preferably accomplished by feeding the composition through a roll mill press apparatus which subjects the bound composition to pressure. About 4,000 (psi) pressure, which is easily obtained from a commercial bakery dough mill, appears to be an adequate compaction pressure. However, the mixture may be formed into sheets by hand kneading techniques, without mechanical pressure, or it may be subjected to pressures of as much as 40,000 psi, or more. While the compaction and formation of sheets of the composition either by hand or by using a roll mill press apparatus has been described, it is within the scope of the present invention to utilize any other type of suitable compaction apparatus, including, but not limited to punch presses and rotary presses, as detailed below.

When compaction is carried out by a roll mill press, the compacted composition exits the roll mill press apparatus in the form of thin sheets, having a thickness of from about 1/32 inch to about 1/4 inch, with 1/16 inch being a good average sheet thickness. At this point, it is preferred that the sheets be set aside to desiccate under ambient conditions. For example, the sheets may be dried at room temperature. However, the drying of the sheets of compacted composition may be enhanced and accelerated by the use of gentle heat, say between about 80° F. and 90° F., for example by the use of passive solar heating. At no time is the composition cooked. Drying is continued until substantially all of the moisture is removed from the composition in the sheets.

Such substantially complete drying is demonstrated by manually grasping an edge of the sheet and bending it. If it is sufficiently dry it will break with a crisp, sharp snap. Not only does drying of the compacted composition remove substantially all of the moisture from the composition, but the drying also appears to assist in the creation of a better gas generating composition.

Comminution of the compacted and dried composition is now required before the composition can be screened. Therefore, after the compacted composition has dried, the dried sheets of composition are comminuted, for example in a standard granulator. Then, the comminuted composition is screened through a series of screens to eliminate particles or fines having a diameter of less than about 0.0111 inch. The first screen in the series is a 1F screen. This 1F screen collects all granules having a diameter equal to or greater than about 0.0582 inch. The granules which are smaller than about 0.0582 inch fall through the 1F screen to a 2F screen below it. The 2F screen collects all granules having a diameter equal to or greater than about 0.0376 inch. The granules which are smaller than about 0.0376 inch and which pass through the 2F screen may be further screened through 3F or 4F screens.

It has been found in the practice of the present invention that about 15% to about 40% of the granules which exit from the granulation apparatus have a diameter less than about 0.0376 inch, and will pass through the 2F screen. Accordingly, it follows that about 60% to 85% of the granules are collected on the 1F and 2F screens. Of the granules which are collected on the 1F and 2F screens, about 90% of the comminuted composition has a diameter equal to or greater than about 0.0582 inch, i.e. about 54% to about 76.5%, are collected on the 1F screen. As noted above, the granules which are collected on the 2F screen have a diameter equal to or greater than about 0.0376 inch. As detailed below, it has been found that the granules which have been produced according to the method of the present invention, and which are collected on the 1F and 2F screens, when mixed together, comprise an improved gas generation composition, useful, for example, as a black powder gunpowder substitute. The mixed granules are suitable for use as propellants in large and small firearms, as explosives, and in any other traditional black powder use. Of course, it is within the skill of the art to select different granule sizes and size mixes to obtain different results for different uses. For example, fines which would pass through a 4F screen have a faster burn rate, and may be used for special effects, and in pyrotechnic displays. Larger particles also have their use, but do not burn as quickly as smaller particles.

The about 15% to about 40% granules which pass through the 2F screen may be reprocessed by itself in the ball mill, or it may be added to a fresh batch of starting ingredients in the ball mill, and reprocessed with that batch, according to the method of the present invention, as detailed above.

An alternative method for producing comminuted granules utilizes a punch press. For example, after the mixed composition exits the ball mill, it is placed into a punch press. As with the process detailed above, an appropriate amount of binder, such as water, may be added to the composition before it is placed into the punch press. The punch press is provided with a plurality of very small molds which are the size of the desired finished product, say small enough to pass through a 1F screen and be caught on a 2F screen. As a result, when the product is pressed by and then extruded from the punch press, small, uniformly sized particles are produced which are substantially the exact size which is desired for the gas composition product. If necessary, the particles may then be set aside to desiccate, for example under ambient conditions, before they are packaged. It is thus seen that by using a punch press, the steps of compacting the composition into thin sheets through a roll mill, drying the thin sheets, comminuting the thin sheets with a granulator, and then screening the comminuted granules are all eliminated. Furthermore, if the punch press is designed to produce short cylindrical particles, such particles will have less surface area than the rough particles which are produced by a granulator, and therefore be less susceptible to the ill effects of ambient humidity.

EXAMPLE

The following weight percent composition has been prepared and found to provide optimum gas generating characteristics:

Potassium nitrate 64.3%

Ascorbic acid 32.1%

Iron oxide 1.8%

Charcoal 1.8%

Figure 2:
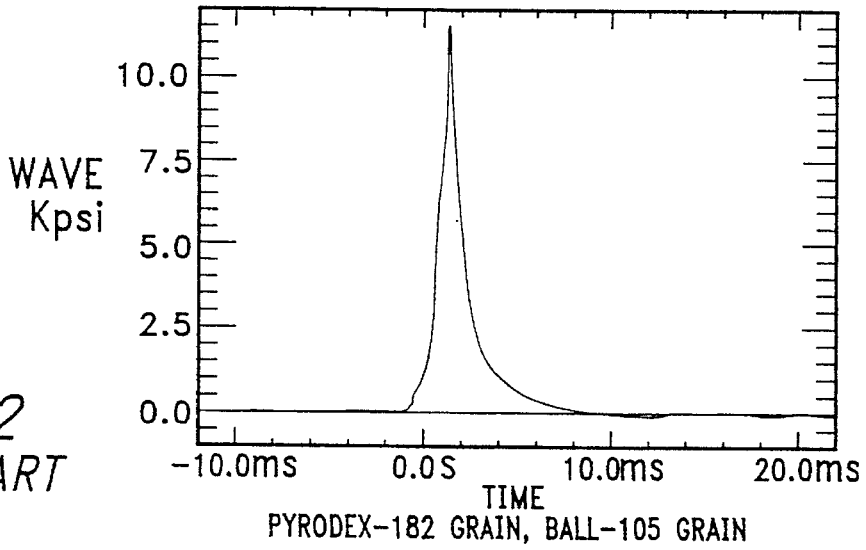
FIG. 2 PRIOR ART

Referring now to the figures, the graph of FIG. 1 illustrates a curve representing pressure evolved versus time during firing of a 182 grain lead ball with a charge weight of 115 grains utilizing the gunpowder substitute produced from the ingredients of the above example by the herein described method of the present invention. The graph of FIG. 2 illustrates a curve representing pressure evolved versus time during firing of a 182 grain lead ball with a charge weight of 105 grains utilizing commercially available, prior art Pyrodex gunpowder substitute. The graph of FIG. 3 illustrates a curve representing pressure evolved versus time during firing of a 182 grain led ball with a charge weight of 100 grains utilizing commercially available, prior art Goex black powder gunpowder substitute.

Figure 3:
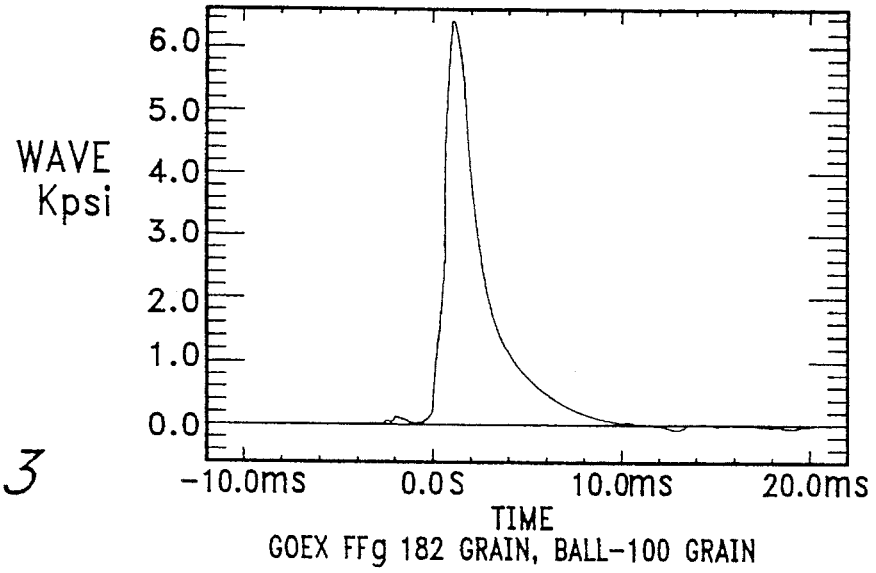

If one were to overlay or otherwise compare the graph of FIG. 1 with the graph of FIG. 2, and/or with the graph of FIG. 3, it would be apparent that the rise in pressure of gunpowder substitute produced from the ingredients of the above example by the herein described method of the present invention comes more slowly than with Pyrodex or Goex, and that the decrease in pressure also occurs more slowly. The rise and the decrease pressure produced by the product of the method of the present invention is more constant. When comparing the figures it is also seen that the peak pressure produced by the product produced by the method of the present invention is significantly lower than that produced by Pyrodex or Goex. This lower pressure is an indicator that the product produced by the method of the present invention is also significantly safer than Pyrodex or Goex.

The final gas generation compositions produced by the process of the present application display adhesive qualities which allow the compositions themselves to be used as a binder. As compared to the gun powder substitutes of the prior art, the burn rate of the composition produced by the process of the present invention appears to be faster. It has been noted that the velocity and distance characteristics provided by the gas generation compositions of the present invention when applied to a lead ball, or other projectile, appear to be a function of the amount of compaction applied to the projectile as it is in contact with the powder in the barrel of a weapon or an ammunition casing. It is further noted that the compositions produced by the process of the present invention do not foul or corrode weapons.

It is thus seen that the gas generation compositions produced by the process of the present invention eliminates the need for cooking the composition, and also reduces the amount of time necessary to reduce the particle size of the ingredients, as compared to Wehrli U.S. Pat. No. 4,997,496. This results in a safer, faster and more cost effective method of producing a gunpowder substitute. It is therefore seen that the present invention teaches and provides a highly improved method of making a gas generation composition which can be utilized as a black powder replacement, for example in the sports shooting market.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. Methods of making gas generation compositions, without cooking, including the step of:

dry mixing a nitrate containing oxidizing agent, and an organic acid selected from the group consisting of ascorbic acid and erythorbic acid to form, without cooking, a dry mixture; and then reducing the size of the dry mixed ingredients to the range between about 30 microns and about 500 microns, with the majority of the dry mixed ingredients in the range between about 100 microns and about 150 microns.

2. The method of claim 1 wherein the nitrate is present in an amount of from about 40% to about 90%, by weight of the total weight of the dry mixture, and the organic acid is present in an amount of from about 10% to about 60%, by weight of the total weight of the dry mixture.

3. The method of claim 2 wherein the dry mixed product mixture includes carbon in an amount of from about 0% to about 15%, by weight of the total weight of the dry mixture, and material selected from the group consisting of iron and iron compounds in an amount of from about 0% to about 15%, by weight of the total weight of the dry mixture.

4. The method of claim 3 wherein the dry mixing is conducted in a ball mill for up to about 180 minutes.

5. The method of claim 4 wherein a binder in an amount of from about 0% to about 10%, by weight of the total weight of the dry mixture is added to the dry mixed product.

6. The method of claim 3 wherein the nitrate is selected from the group consisting alkali nitrates, alkaline earth metal nitrates, and ammonium nitrates.

7. The method of claim 6 wherein the nitrate containing oxidizing agent includes potassium nitrate.

8. The method of claim 7 wherein the organic acid includes ascorbic acid.

9. The method of claim 8 wherein the dry mixing is conducted in a ball mill for up to about 120 minutes.

10. The method of claim 8 wherein the dry mixed product mixture has water added to it as a binder in an amount of from about 0% to about 5%, by weight of the total weight of the dry mixture.

11. The method of claim 10 wherein potassium nitrate is present in an amount of from about 55% to about 70%, by weight of the total weight of the dry mixture, and the ascorbic acid is present in an amount of from about 10% to about 40%, by weight of the total weight of the dry mixture.

12. The method of claim 11 wherein the dry mixed product mixture includes carbon in an amount of from about 0% to about 7%, by weight of the total weight of the dry mixture, and material selected from the group consisting of iron and iron compounds in an amount of from about 0% to about 7%, by weight of the total weight of the dry mixture.

13. The method of claim 12 wherein the carbon includes charcoal and the material selected from the group consisting of iron and iron compounds includes one or more iron oxide.

14. The method of claim 13 wherein the iron oxide includes $Fe_3O_4$.

15. The method of claim 14 wherein the charcoal includes wood charcoal.

16. The method of claim 12 wherein the material selected from the group consisting of iron and iron compounds includes $Fe_3O_4$, and the carbon includes wood charcoal.

17. The method of claim 16 wherein the dry mixing is conducted in a ball mill for up to about 90 minutes, and the majority of the dry mixed ingredients are reduced to a size in the range of between about 30 microns and about 500 microns, and the majority of the potassium nitrate and ascorbic acid is reduced to a size in the range of between about 100 microns and about 150 microns.

18. The method of claim 17 wherein the dry mixed product mixture has water added to it as a binder in an amount of from about 0% to about 5%, by weight of the total weight of the dry mixture.

19. A method of making gas generation compositions having utility as gunpowder substitute mixtures, without cooking, including the steps of:

dry mixing an oxidizing agent including potassium nitrate present in an amount of about 64.3%, by weight of the total weight of the dry mixture, an organic acid including ascorbic acid present in an amount of about 32.1%, by weight of the total weight of the dry mixture, charcoal, present in an amount of about 1.8% by weight of the total weight of the dry mixture, and $Fe_3O_4$ present in an amount of about 1.8% by weight of the total weight of the dry mixture, to form a dry mixed product mixture;

reducing the size of the dry mixed ingredients to the range between about 30 microns and about 500 microns, with the majority of the dry mixed ingredients in the range between about 100 microns and about 150 microns;

introducing water as a binder to the mixture;

compacting the mixture;

drying the compacted mixture; and then comminuting the mixture to form granules.

20. The method of claim 37 wherein the step of mixing utilizes a ball mill.

21. The method of claim 20 further including the step of compacting the mixture by the use of a roll mill press apparatus which exerts up to about 40,000 psi of compacting pressure to the mixture.

22. The method of claim 21 wherein the roll mill press apparatus exerts up to about 4,000 psi of compacting pressure to the mixture.

23. The method of claim 21 wherein the mixture is compacted into thin sheets having a thickness of from about 1/32 inch to about 1/4 inch during compacting.

24. The method of claim 23 further including the step of drying the thin sheets of compacted mixture, without cooking.

25. The method of claim 24 wherein the sheets of compacted mixture are dried under ambient conditions.

26. The method of claim 25 further including the step of comminuting the compacted dried mixture to form granules.

27. The method of claim 26 wherein the granules are screened to one or more selected size.

28. The method of claims 4, 10, 17 and 37 including the step of placing the mixture in a punch press to form punched granules of a preselected size.

29. A method of making a gas generation composition having utility as gunpowder substitute mixture, without cooking, including the steps of:

dry mixing an oxidizing agent including potassium nitrate, an organic acid including ascorbic acid, carbon, and iron oxide to form a dry mixed product mixture;

reducing the size of the dry mixed ingredients to the range between about 30 microns and about 500 microns, with the majority of the dry mixed ingredients in the range between about 100 microns and about 150 microns;

introducing water as a binder to the mixture;

compacting the mixture;

drying the compacted mixture; and then comminuting the mixture to form granules.

30. The gunpowder substitute compositions made by the method of claim 19.

31. The method of claim 38 wherein the binder includes water, and wherein the amount of water is about 1.5% by weight of the dry mixture.

32. The method of claim 31 wherein the dry mixing is carried out in a ball mill for up to about 90 minutes; wherein the compacting is carried out in a roll mill which exerts up to about 4,000 psi of compacting pressure to the mixture to form thin sheets having a thickness of from about 1/32 inch to about 1/4 inch; then comminuting the sheets in a granulator, and then screening the granules to a selected size.

33. Methods of making gas generation compositions, without cooking, including the steps of:

dry mixing an oxidizing agent, and an organic acid to form, a dry mixture; and then reducing the size of the majority of the oxidizing agent and organic acid to the range of between about 30 microns, and about 500 microns, all without cooking.

34. The gas generation compositions having utility as gunpowder substitute produced by the methods of claims 1, 2, 12, 29 and 33, all without cooking.

35. The gas generation compositions having improved shelf life, and having utility as gunpowder substitute produced by the methods of claim 13, 14, 15, 16, 37, 30 and 31, all without cooking.

36. Methods of making gas generation compositions, without cooking, including the steps of:

forming a mixture including a nitrate containing oxidizing agent selected from the group consisting of alkali nitrates, alkaline earth metal nitrates, and ammonium nitrate present in an amount of from about 55% to about 70%, by weight of the total weight of the mixture, and an organic acid selected from the group consisting of ascorbic acid and erythorbic acid present in an amount of from about 10% to about 40%, by weight of the total weight of the mixture, carbon in an amount of from about 0% to about 7%, by weight of the total weight of the mixture, and iron oxide in an amount of from about 0% to about 7%, by weight of the total weight of the mixture;

dry mixing said mixture without cooking for up to about 90 minutes so that the ingredients are in the size range of between about 30 microns and about 500 microns, with the majority of the ingredients in the mixture are reduced to a size in the range of between about 100 microns and about 150 microns; and then adding water to the dry mixture in an amount of from about 0% to about 5%, by weight of the total weight of the dry mixture.

37. The method of claim 36 wherein the nitrate containing oxidizing agent includes potassium nitrate and the organic acid includes ascorbic acid.

38. The gas generation compositions made by the method of claim 37.

* * * * *